US012808121B2

(12) United States Patent
Lindstedt et al.

(10) Patent No.: US 12,808,121 B2
(45) Date of Patent: Nov. 24, 2026

(54) PRODUCT OF PAPERBOARD HAVING IMPROVED PRINTING PROPERTIES

(71) Applicant: Billerud Aktiebolag (Publ), Solna (SE)

(72) Inventors: Thomas Lindstedt, Karlstad (SE); Stefan Ericsson, Koping (SE)

(73) Assignee: BILLERUD AKTIEBOLAG (PUBL), Solna (SE)

( * ) Notice: Subject to any disclaimer, the term of this patent is extended or adjusted under 35 U.S.C. 154(b) by 189 days.

(21) Appl. No.: 18/571,357

(22) PCT Filed: Jun. 9, 2022

(86) PCT No.: PCT/EP2022/065746
§ 371 (c)(1),
(2) Date: Dec. 18, 2023

(87) PCT Pub. No.: WO2022/263294
PCT Pub. Date: Dec. 22, 2022

(65) Prior Publication Data

US 2024/0279874 A1 Aug. 22, 2024

(30) Foreign Application Priority Data

Jun. 18, 2021 (EP) ..... 21180362

(51) Int. Cl.
*D21H 11/04* (2006.01)
*D21H 27/30* (2006.01)

(52) U.S. Cl.
CPC ..... *D21H 11/04* (2013.01); *D21H 27/30* (2013.01)

(58) Field of Classification Search
CPC ..... D21H 11/04; D21H 27/30; D21H 11/08; D21H 11/10; D21H 11/14
See application file for complete search history.

(56) References Cited

U.S. PATENT DOCUMENTS 5,169,496 A * 12/1992 Wagle ..... D21C 9/185 162/125
6,540,873 B2 * 4/2003 Leandersson ..... D21F 3/0218 162/360.2
6,616,811 B2 * 9/2003 Wassermann ..... D21F 11/08 162/133
6,855,228 B1 * 2/2005 Perini ..... D21F 11/04 428/153
7,387,702 B2 * 6/2008 Norlander ..... B32B 29/00 428/536
7,608,165 B2 * 10/2009 Raisanen ..... D21F 9/006 162/217
7,988,825 B2 * 8/2011 Aula ..... D21F 9/006 162/132
11,299,853 B2 * 4/2022 Hoglund ..... D21H 11/10
2002/0162636 A1 * 11/2002 Halmschlager ..... D21F 11/04 162/298
2004/0099388 A1 5/2004 Chen
2005/0039874 A1 * 2/2005 Halmschlager ..... D21F 9/006 162/298
2017/0335522 A1 11/2017 Heiskanen et al.
2018/0141319 A1 * 5/2018 Ankerfors ..... D21H 17/66
2019/0218716 A1 * 7/2019 Hoglund ..... D21H 11/02

FOREIGN PATENT DOCUMENTS

BR 112019005554 B1 * 11/2024
CN 104805737 A 7/2015
DE 4401761 C2 * 4/1997 ..... D21F 9/006
EP 312512 A1 * 4/1989 ..... D21F 11/04
EP 664356 A2 * 7/1995 ..... D21F 11/04
EP 1 936 032 A1 6/2008
EP 3 805 453 A1 4/2021
EP 4105381 B1 * 5/2023 ..... D21H 27/30
EP 4389972 A1 * 6/2024 ..... B32B 27/10
EP 4566818 A1 * 6/2025 ..... B32B 29/00
EP 3516110 B1 * 8/2025 ..... D21H 11/10
JP WO2015/041276 A1 3/2015
SE 2330311 A1 * 1/2025 ..... D21H 27/30
SE 547523 C2 * 10/2025
WO WO95/34711 A1 12/1995
WO WO 9711227 A1 3/1997
WO WO-2006084883 A1 * 8/2006 ..... D21H 27/38
WO WO 2009/153225 A1 12/2009
WO WO 2015/087293 A1 6/2015
WO WO 2016/140609 A1 9/2016
WO WO 2017/006216 A1 1/2017
WO WO 2019/180303 A1 9/2019
WO WO 2021/059219 A1 4/2021

(Continued)

OTHER PUBLICATIONS

Paper vocabulary, SS 15 20 05 Utgava 4, TNC 92; Jan. 29, 1992.
Declaration by Juha Kovanen, including ashort CV and Examples for paperboard structure and headbox design; Feb. 26, 2025.
Solberg, et al., Experimental report; Feb. 21, 2025; pp. 1-12.
Screenshots from Internet Archive ("Wayback Machine") concerning website http://www.sca.com/en/pulp/rroaucts1/ Star1 in the version crawled Aug./Sep. 2011.
Lundstrom, Fredrik, "Lighter cartonboard with HT-CTMP" Forward Valmet's Costumer Magazine, vol. 3/2020, 2020.
Larsson, Kjell-Arne, "Bjork CTMP—ny massa i Fors" Nordiska projekt Industri, No. 2015-2, 2015.

(Continued)

*Primary Examiner* — Jose A Fortuna
(74) *Attorney, Agent, or Firm* — Stites & Harbison PLLC; Richard S. Myers, Jr.

(57) ABSTRACT

There is provided a method of forming a multi-layered paperboard comprising a bottom layer, a top layer and a middle layer arranged between the top layer and the bottom layer, wherein the middle layer is formed from a middle layer furnish comprising at least 30% by dry weight of a HT-CTMP from a mixture of hardwood and softwood, which middle layer furnish is fed to a wire from a middle layer head box in which the consistency is above 0.30%, such as above 0.40%, such as at least 0.43%.

19 Claims, No Drawings

(56) References Cited

FOREIGN PATENT DOCUMENTS

| | | | | |
|---|---|---|---|---|
| WO | WO-2025093394 | A1 * | 5/2025 | ..... D21H 27/38 |
| WO | WO-2025202957 | A1 * | 10/2025 | ..... D21F 11/04 |

OTHER PUBLICATIONS

Adanur, Sabit, "Paper Machine Clothing: Key to the Paper Making Process" CRC Press, 1997, Ed. 1st ed.

Vesterlind, Eva-Lotta, "Chemithermomechanical pulp made from birch at high temperature" Nordic Pulp and Paper Research Journal, vol. 21, No. 2/2006, 2006.

Vesterlind, Eva-Lotta, "High Temperature CTMP from Birch" Sundsvall: FSCN, 2006 ISBN: 91-85317-20-9.

Gavelin, Gunnar, "Papp och Kartong" Skogsindustrins Utbildning i Markaryd AB Forlaget, 1995 ISBN: 91-7322-182-1.

* cited by examiner

PRODUCT OF PAPERBOARD HAVING IMPROVED PRINTING PROPERTIES

CROSS REFERENCE TO RELATED APPLICATIONS

This application is a § 371 National Phase Application of PCT/EP2022/065746 filed Jun. 9, 2022, which claims priority to EP21180362.2 filed Jun. 18, 2021.

TECHNICAL FIELD

The present disclosure relates to the field of paperboard production.

BACKGROUND

Paperboard often has several layers, including a top layer intended to be printed, a bottom/reverse layer and at least one middle layer. The top layer is often provided with a pigment coating to improve printing properties. To obtain high bending stiffness at a relatively low consumption of cellulose fibres, the middle layer(s) typically have relatively high bulk (i.e., low density). To achieve high bulk, CTMP is often included in the pulp mixture used to form the middle layer. CTMP is traditionally formed from softwood (e.g., spruce). The type of pulp used for forming the top and the bottom layer has been mainly kraft pulp.

SUMMARY

High headbox consistency is generally associated with poor printing properties. This is not only the case for the headbox consistency used for forming the top/printing layer, but also for the headbox consistency used for forming the middle layer arranged below the top/printing layer. Still, it is advisable to have a relatively high headbox consistency in some methods of making paperboard, e.g., when the headbox have a certain design (i.e., the energy-efficient "low turbulence" design used by headbox suppliers Escher Wyss and now Voith), when middle layers of higher grammages are formed and/or to facilitate higher machine speeds.

The present inventors have realized that the printing properties should not be improved by lowering the headbox consistency, but by modifying the composition of the middle layer furnish. However, the modified furnish should still produce a middle layer that meet other paperboard requirements.

Accordingly, there is provided a method of forming a multi-layered paperboard comprising a bottom layer, a top layer and a middle layer arranged between the top layer and the bottom layer, wherein the middle layer is formed from a middle layer furnish comprising at least 30% by dry weight of a HT-CTMP from a mixture of hardwood and softwood, which middle layer furnish is fed to a wire from a middle layer head box in which the consistency is above 0.30%, such as above 0.40%, such as at least 0.43%.

DETAILED DESCRIPTION

The present disclosure provides a method of forming a multi-layered paperboard comprising a bottom layer, a top layer and a middle layer. As understood by the skilled person, the middle layer is arranged between the top layer and the bottom layer. Normally, the middle layer has a lower density than the top layer and the bottom layer. The top layer is typically intended for printing and may thus be covered by a pigment coating. The pigment coating may have one or more layers, such as one, two or three layers. In one embodiment, also the bottom layer is covered by a pigment coating. The total coat weight (dry) of the pigment coating provided on the top layer may be 10-40 g/m$^2$. The coat weight (dry) of the pigment coating provided on the bottom layer may be 4-15 g/m$^2$, such as 5-10 g/m$^2$. Application of coating compositions is further discussed below.

The method is preferably carried out in a full-scale paperboard machine comprising a forming section, a pressing section and a drying section. The full-scale paperboard machine may further comprise a coating section arranged downstream the drying section. In one embodiment, the full-scale paperboard machine comprises at least on calender arranged downstream the drying section or in a downstream region of the drying section. When the coating section is included, the calender is typically arranged upstream thereof. A full-scale paperboard machine typically produces at least 50,000 tonnes of paperboard per year.

The middle layer is formed from a middle layer furnish comprising at least 30% by dry weight of a HT-CTMP characterized by that it is formed from a mixture of hardwood and softwood. In one embodiment, the middle layer furnish comprises at least 35% by dry weight of the HT-CTMP, such as at least 40% by dry weight of the HT-CTMP. A typical upper limit may be 60% by dry weight.

The hardwood may be aspen, birch or eucalyptus.

The term HT-CTMP (high-temperature chemithermomechanical pulp) refers to CTMP that has, during the production thereof, been heated to a temperature of at least 140° C., preferably of at least 150° C., more preferably of at least 160° C., prior to the refining step.

The Canadian Standard Freeness measured according to ISO 5267-2:2001 of the HT-CTMP may be 500-650 ml, such as 530-630 ml. The HT-CTMP may be bleached.

The middle layer furnish may further comprise broke pulp, such as at least 30% (by dry weight) of a broke pulp, such as at least 40% (by dry weight) of a broke pulp.

The Schopper-Riegler number measured according to ISO 5267-1:1999 of the broke pulp may be 26-34, such as 28-32.

In one embodiment, the middle layer furnish further comprises chemical pulp, such as 5-25% (by dry weight) of a kraft pulp. The kraft pulp may be softwood kraft pulp.

To form the middle layer, the middle layer furnish is fed to a wire from a middle layer head box. In the middle layer head box, the consistency of the middle layer furnish is above 0.30%, such as above 0.40%, such as at least 0.43%. A typical upper limit for the consistency in the middle layer head box is 0.80%, such as 0.70%.

In one embodiment, the mixture comprises 20-80% softwood and 20-80% hardwood. Preferably, the hardwood is included in a higher proportion than the softwood.

In one embodiment, the grammage of the middle layer is at least 130 g/m$^2$, such as at least 140 g/m$^2$, such as at least 145 g/m$^2$. An upper limit may be 210 g/m$^2$. The papermaker knows the grammage of each layer that he/she is producing.

The grammage of the complete multi-layered paperboard (including any pigment coating(s)) may be at least 250 g/m$^2$, such as at least 260 g/m$^2$, such as at least 270 g/m$^2$. An upper limit may be 400 g/m$^2$.

The density (ISO 534:2011) of the complete multi-layered paperboard (including any pigment coating(s)) may be below 800 kg/m$^3$, such as below 750 kg/m$^3$, such as below 725 kg/m$^3$. A lower limit may be 650 kg/m$^3$.

The density (ISO 534:2011) of the middle layer may be below 625 kg/m$^3$, such as below 600 kg/m$^3$.

To separate the middle layer from the multi-layered paperboard and thus facilitate the density measurement, a FORTUNA Bandknife-Splitting Machine (Type AB 320 E/P) can be used. Such a machine that has been customized for paperboard splitting is commercially available and is used by several major companies in the paperboard field.

Alternatively, a surface grinding technique can be used to remove all layers but the middle layer in question. Such a surface grinding is one of the services that are commercially available at RISE Bioeconomy (formerly Innventia) in Stockholm, Sweden.

In one embodiment, the top layer is formed from a top layer furnish comprising at least 50% by dry weigh of kraft pulp, such as at least 80% by dry weigh of kraft pulp. The kraft pulp of the top layer may be bleached.

Further, the top layer furnish may comprise a mixture of hardwood pulp and softwood pulp.

In one embodiment, hardwood kraft pulp constitutes at least 80% by dry weight of the top layer furnish. In another embodiment, hardwood kraft pulp and softwood kraft pulp together constitute at least 80% by dry weight of the top layer furnish In one embodiment, the bottom layer is formed from a bottom layer furnish comprising at least 50% by dry weigh of kraft pulp, such as at least 70% by dry weigh of kraft pulp. The kraft pulp of the bottom layer is typically softwood kraft pulp or a mixture of hardwood kraft pulp and softwood kraft pulp.

In one embodiment, the multi-layered paperboard comprises more than one middle layer arranged between the top layer and the bottom layer.

The method may comprise a step of online coating the multi-layered paperboard with at least one pigment coating composition. The coating step may comprise several sub-steps. As an example, at least two pigment coating layers may be added to the top layer in at least two sub-steps. Another sub-step may be coating of the bottom layer. Equipment suited for on-line coating of paperboard is known to the skilled person.

EXAMPLES

Inventive Trial

An embodiment of the method of the present disclosure was carried out in full scale in a paperboard machine.

To prepare a top layer furnish, bleached hardwood kraft pulp was subjected to LC refining (75 kWh/tonne) resulting in a SR number of 30. Bleached softwood kraft pulp was also subjected to LC refining (150 kWh/tonne) resulting in a SR number of 30. After refining, the pulps were mixed in a 75/25 dry weight ratio (hardwood/softwood). Before the top layer headbox, rosin size (0.9 kg/tonne), alum (2.3 kg/tonne), strength agent (cationic starch, 2.5 kg/tonne), retention starch (3 kg/tonne), retention polymer (75 g/tonne), silica (300 g/tonne) and clay (75 kg/tonne) were added. In the top layer headbox, the consistency was 0.19% and the pH was 6.8.

To prepare a bottom layer furnish, bleached softwood kraft pulp was subjected to LC refining (70 kWh/tonne) resulting in a SR number of 20. Before the bottom layer headbox, rosin size (1.0 kg/tonne), alum (2.3 kg/tonne), strength agent (cationic starch, 2.5 kg/tonne), retention starch (3 kg/tonne), retention polymer (100 g/tonne), silica (300 g/tonne) and clay (20 kg/tonne) were added. In the bottom layer headbox, the consistency was 0.15% and the pH was 6.8.

To prepare a middle layer furnish, bleached softwood kraft pulp was subjected to LC refining (90 kWh/tonne) resulting in a SR number of 20. Further, bleached HT-CTMP formed from a mixture of hardwood and softwood was subjected to LC refining (20 kWh/tonne) resulting in a CSF of 580 ml and broke pulp was refined to the extent it obtained a SR number of 30. After refining, the pulps were mixed in a 15/40/45 dry weight ratio (softwood kraft pulp/CTMP/broke pulp). Before the middle layer headbox, rosin size (2.5 kg/tonne), alum (3.8 kg/tonne), retention starch (3 kg/tonne), retention polymer (100 g/tonne) and silica (350 g/tonne) were added. In the middle layer headbox, the consistency was 0.43% and the pH was 6.8. The wire used for forming the middle layer included a breast roll shaker.

In the wire section, 0.5 g/m$^2$ starch was sprayed to each of the top layer web and the bottom layer web for ply-bond strength. At the end of the wire section, the three individual webs were couched together to form a three-layered web. The wire speed was 583 m/min. In the press section arranged downstream the wire section, the three-layered web was pressed in three nips; a first shoe press nip (490 kN/m) followed by a second shoe press nip (750 kN/m) followed by a hard nip (50 kN/m).

Downstream the press section, the three-layered web was dried in a drying section and then calendered in a hard nip calender at a line load of 30 kN/m. After the calendering, the web was coated in a coating section having four stations. In the first station, which was a metering size press (MSP), 5 g/m$^2$ (dry) of a pigment coating composition was coated onto the top surface. In the second station, which was a blade coater, another 9 g/m$^2$ of a pigment coating composition was coated onto the top surface. In the third station, which was a metering size press (MSP), 7 g/m$^2$ of a pigment coating composition was coated onto the bottom surface. carried out in a drying section. In the fourth station, which was a blade coater, another 9 g/m$^2$ of a pigment coating composition was coated onto the top surface. Hence a total of 23 g/m$^2$ was coated onto the top surface and a total of 7 g/m$^2$ was coated onto the bottom surface.

The properties of the resulting paperboard are presented in table 1 below.

Reference Trial

The reference trial was carried out in the same way as the inventive trial presented above, but with the following exceptions:

- a "normal" bleached softwood CTMP that was LC-refined to a CSF of 650 ml was used instead of the bleached HT-CTMP formed from the hardwood/softwood mixture; and
- the line load in the hard nip calender was 60 kN/m instead of 30 kN/m.

The properties of the resulting paperboard are presented in table 1 below.

TABLE 1

| Property | Inventive trial | Reference trial |
|---|---|---|
| Paperboard grammage (g/m$^2$) | 294 | 305 |
| Top layer grammage (g/m$^2$) | 67 | 67 |
| Middle layer grammage (g/m$^2$) | 146 | 157 |
| Bottom layer grammage (g/m$^2$) | 51 | 51 |
| Paperboard thickness (μm) | 409 | 404 |
| Paperboard density (kg/m$^3$) | 720 | 756 |
| Bendtsen Roughness* (ml/min) | 33.7 | 62.8 |
| PPS roughness* (μm) | 1.20 | 1.37 |

TABLE 1-continued

| Property | Inventive trial | Reference trial |
|---|---|---|
| Scott Bond (J/m$^2$) | 168 | 232 |
| Z strength (kPa) | 357 | 375 |
| Bending stiffness (mNm) | 297 | 289 |
| Bending stiffness index (Nm$^7$kg$^3$) | 11.6 | 10.1 |
| SCT (N/m) | 8.72 | 9.36 |
| SCT index (Nm/g) | 29.7 | 30.7 |

*Measured on the top side

As shown by table 1, the inventive trial resulted in a paperboard of at least comparable and in some cases improved properties when compared to those of the paperboard produced in the reference trial.

In addition, the inventors' impression of the outcome of the inventive trial was that it resulted in the greatest improvement of printing properties they had ever seen in a full-scale machine trial.

The inventors' impression is surprising in view of that the line load in the hard nip calender was reduced in the inventive trial compared to the reference trial and that reduced line load is normally associated with impaired printing properties.

The reduced density shown in table 1 can at least partly be explained by the reduced line load.

Notably, the taste and odour problems sometimes associated with the use of hardwood CTMP were not encountered in the inventive trial.

Visual Scoring of Print Quality

A panel of 12 people was recruited to visually analyse and score the print quality of seven different samples in a blinded study. Paperboard produced according to the Reference trial described above was used for samples 2 and 3. Sample 2 was obtained from a centre reel. Sample 3 was obtained from an edge reel. Paperboard produced according to the Inventive trial described above was used for samples 4 and 5. A paperboard produced according to the Inventive trial described above, but with a line load of 40 kN/m in the hard nip calender, was used for samples 6 and 7. Samples 4 and 6 were obtained from centre reels and samples 5 and 7 were obtained from edge reels. Sample 1 was obtained from paperboard produced on another paper machine using "traditional" softwood CTMP.

For each sample, two prints were made. The first print was a photograph of a woman. The second print was a photograph of a flower (a dandelion).

For each print, each panelist made pairwise visual comparisons of all samples without any knowledge of the identity of the paperboard (blinded study). For each pair, two points were awarded. If one printed sample was considered to have a better print quality than the other, it was given two points, while the other printed sample was given zero points. If the print qualities were considered to be equal, the samples were given one point each.

For each panelist, the points given to each print of each sample were then summarized (each print of each sample underwent six pairwise comparisons and could thus get from zero (0) to twelve (12) points). The results are presented in tables 2 and 3 below.

TABLE 2

The first print.

| Sample | Ref. 1 | Ref. 2 | Ref. 3 | Inventive 4 | Inventive 5 | Inventive 6 | Inventive 7 |
|---|---|---|---|---|---|---|---|
| Panellist 1 | 0 | 2 | 4 | 12 | 10 | 8 | 6 |
| Panellist 2 | 1 | 1 | 9 | 5 | 10 | 8 | 8 |
| Panellist 3 | 0 | 6 | 6 | 6 | 10 | 6 | 8 |
| Panellist 4 | 0 | 5 | 5 | 8 | 11 | 5 | 8 |
| Panellist 5 | 1 | 2 | 5 | 7 | 8 | 9 | 10 |
| Panellist 6 | 0 | 2 | 4 | 10 | 10 | 10 | 8 |
| Panellist 7 | 0 | 2 | 4 | 10 | 8 | 12 | 6 |
| Panellist 8 | 0 | 5 | 7 | 9 | 6 | 8 | 7 |
| Panellist 9 | 0 | 2 | 4 | 6 | 10 | 10 | 10 |
| Panellist 10 | 2 | 5 | 3 | 8 | 10 | 7 | 7 |
| Panellist 11 | 2 | 2 | 2 | 12 | 8 | 10 | 6 |
| Panellist 12 | 1 | 1 | 5 | 7 | 12 | 8 | 8 |
| Average score | 0.6 | 2.9 | 4.8 | 8.3 | 9.4 | 8.4 | 7.7 |

TABLE 3

The second print.

| Sample | Ref. 1 | Ref. 2 | Ref. 3 | Inventive 4 | Inventive 5 | Inventive 6 | Inventive 7 |
|---|---|---|---|---|---|---|---|
| Panellist 1 | 3 | 1 | 2 | 9 | 8 | 10 | 9 |
| Panellist 2 | 1 | 1 | 6 | 8 | 10 | 7 | 9 |
| Panellist 3 | 6 | 0 | 2 | 10 | 10 | 4 | 10 |
| Panellist 4 | 3 | 0 | 3 | 7 | 8 | 9 | 12 |
| Panellist 5 | 2 | 2 | 2 | 7 | 8 | 12 | 9 |
| Panellist 6 | 2 | 3 | 1 | 10 | 7 | 8 | 11 |
| Panellist 7 | 0 | 3 | 3 | 12 | 8 | 7 | 9 |
| Panellist 8 | 3 | 6 | 6 | 7 | 6 | 7 | 7 |
| Panellist 9 | 0 | 4 | 2 | 9 | 9 | 9 | 9 |
| Panellist 10 | 2 | 3 | 2 | 8 | 9 | 9 | 9 |
| Panellist 11 | 4 | 9 | 5 | 12 | 2 | 7 | 3 |
| Panellist 12 | 6 | 4 | 6 | 6 | 4 | 8 | 8 |
| Average score | 2.7 | 3.0 | 3.3 | 8.8 | 7.4 | 8.1 | 8.8 |

Tables 2 and 3 show that the inventive board production undoubtedly resulted in much better print quality than the references. Tables 2 and 3 thus confirm the inventors' impression discussed above.

The invention claimed is:

1. A method of forming a multi-layered paperboard comprising a bottom layer, a top layer and a middle layer arranged between the top layer and the bottom layer, wherein the middle layer is formed from a middle layer furnish comprising at least 30% by dry weight of a High-Temperature Chemi-Thermomechanical Pulp (HT-CTMP) from a mixture of hardwood and softwood, which middle layer furnish is fed to a wire from a middle layer head box in which the consistency is above 0.30%.

2. The method of claim 1, wherein the middle layer furnish comprises at least 35% by dry weight of the HT-CTMP.

3. The method of claim 1, wherein the middle layer furnish comprises at least 30% of a broke pulp.

4. The method of claim 1, wherein the middle layer furnish comprises 5-25% of a kraft pulp.

5. The method of claim 1, wherein the mixture comprises 20-80% softwood and 20-80% hardwood.

6. The method of claim 1, wherein the grammage of the middle layer is at least 130 $g/m^2$.

7. The method of claim 1, wherein the grammage of the multi-layered paperboard is at least 250 $g/m^2$.

8. The method of claim 1, wherein the density of the multi-layered paperboard is below 800 $kg/m^3$.

9. The method of claim 1, wherein the top layer is formed from a top layer furnish comprising at least 50% by dry weigh of kraft pulp.

10. The method of claim 9, wherein the top layer furnish comprises a mixture of hardwood pulp and softwood pulp.

11. The method of claim 1, wherein the bottom layer is formed from a bottom layer furnish comprising at least 50% by dry weigh of kraft pulp.

12. The method of claim 1, wherein the middle layer furnish is fed to a wire from a middle layer head box in which the consistency is at least 0.43%.

13. The method of claim 1, wherein the middle layer furnish comprises at least 40% by dry weight of the HT-CTMP.

14. The method of claim 1, wherein the middle layer furnish comprises at least 40% of a broke pulp.

15. The method of claim 1, wherein the grammage of the middle layer is at least 145 $g/m^2$.

16. The method of claim 1, wherein the grammage of the multi-layered paperboard is at least 270 $g/m^2$.

17. The method of claim 1, wherein the density of the multi-layered paperboard is below 725 $kg/m^3$.

18. The method of claim 1, wherein the top layer is formed from a top layer furnish comprising at least 80% by dry weigh of kraft pulp.

19. The method of claim 1, wherein the bottom layer is formed from a bottom layer furnish comprising at least 70% by dry weigh of kraft pulp.

* * * * *